United States Patent [19]

Roth et al.

[11] Patent Number: 4,945,648

[45] Date of Patent: Aug. 7, 1990

[54] MITERING GAUGE

[75] Inventors: Klaus Roth, Viernheim; Lothar Gerhardy, Heidelberg, both of Fed. Rep. of Germany

[73] Assignee: ISOVER SAINT-GOBAIN, Courbevoie, France

[21] Appl. No.: 302,204

[22] Filed: Jan. 27, 1989

[30] Foreign Application Priority Data

Feb. 8, 1988 [DE] Fed. Rep. of Germany ..... 8801561

[51] Int. Cl.[5] ..... B27G 5/02

[52] U.S. Cl. ..... 33/529; 83/762

[58] Field of Search ..... 33/524, 529, 21.3; 83/746, 761, 762

[56] References Cited

U.S. PATENT DOCUMENTS

| | | | |
|---|---|---|---|
| 1,123,050 | 12/1914 | Wellman | 83/762 |
| 1,721,937 | 7/1929 | Williams | 83/762 |
| 2,717,454 | 9/1955 | Sekki | 33/529 |
| 2,893,131 | 7/1959 | DePeu | 33/529 |
| 3,209,459 | 10/1965 | Fish, Jr. | 33/529 |
| 3,811,356 | 5/1974 | Wyler | 83/762 |
| 3,837,253 | 9/1974 | Slemmons | 83/762 |
| 3,935,779 | 2/1976 | Hildebrandt et al. | 83/762 |
| 4,300,755 | 11/1981 | Potvin | 83/762 |
| 4,653,195 | 3/1987 | Esparza | 33/529 |

FOREIGN PATENT DOCUMENTS

| | | | |
|---|---|---|---|
| 0119890 | 9/1984 | European Pat. Off. | 83/762 |
| 8313384 | 11/1983 | Fed. Rep. of Germany . | |
| 0627815 | 10/1927 | France | 83/761 |
| 0020236 | of 1903 | United Kingdom | 83/761 |
| 2123743 | 2/1984 | United Kingdom | 83/746 |

*Primary Examiner*—Thomas B. Will

*Attorney, Agent, or Firm*—Oblon, Spivak, McClelland, Maier & Neustadt

[57] ABSTRACT

Disclosed is a mitering gauge for cutting pipe shaped members, the gauge including a console and at least one upright side member having an oblique end face for guiding a cutting tool. The mitering gauge provides both guidance of the cutting tool and guidance of the member to be cut.

6 Claims, 1 Drawing Sheet

MITERING GAUGE

BACKGROUND OF THE INVENTION

1. Field of the Invention

The invention relates to a mitering gauge for cutting miters particularly on pipe insulating shells which consist of mineral fibers and comprising a console and at least one upright side member having an oblique end face to guide a cutting tool.

2. Discussion of the Background

A mitering gauge for cutting miters on pipe insulating shells is already known from German Utility Model Reference No. 83 13 384. It consists of a U-shaped body on the side members of which there are aligned cut-outs. The cut-outs provided are of a V-shape, the sloping edges forming an angle of 45°, 22.5° C., 15° or 11.5° with the perpendicular to the end edge of the side member. The side members of the U-shaped body are in this case bolted to the console by means of wing nuts.

Although this mitering gauge can be dismantled into three component parts, so reducing the space required during transport, its component parts are nevertheless relatively large and therefore cumbersome. In addition, the individual parts are of solid construction and are thus relatively heavy. Finally, the multiplicity of envisaged V-shaped cutouts is not needed for the normal fitting of pipe insulating shells on heating pipes for example. Consequently, they are an unnecessary burden.

When such a mitering gauge is used, the procedure is to place the pipe insulating shell on the console of the gauge, between the side members, whereupon a cutting knife is used to make suitable cut-outs in the pipe insulating shell, corresponding to the cut-outs in the mitering gauge. To do so, the cutting knife is placed on the obliquely extending edges of the V-shaped cut-outs and guided against these edges while the cuts are being made. It has however been found that in the case of mitering gauges which have relatively thin lateral side members, there is a danger of the cutting knife cutting into the obliquely extending edges. This means that the edges can no longer perform their function of perfectly guiding the cutting blade, so that the mitering gauge as a whole becomes unusuable. A widening of the said edges, or guide surfaces, in order to avoid an unintentional cutting into them does however entail an increase in the overall weight of the mitering gauge, so that its ease of handling once again suffers. Last but not least, more material also means increased costs. Finally, in the case of such a mitering gauge, relatively small diameter pipe insulating shells are not satisfactorily guided because the distance between the side members is fixed.

SUMMARY OF THE INVENTION

It is on this premise that the innovation is based; it deals with the problem of suggesting a mitering gauge in which both guidance of the cutting tool and also guidance of the pipe insulating shells which are to be cut can be guaranteed without problems occurring, in fact without any increase in the cost nor any substantial increase in the weight in comparison with prior art mitering gauges.

This problem is simply resolved in that the thickness of the body of the side members of a mitering gauge is kept considerably smaller than the width of the guide surfaces. This can be advantageously achieved due to the fact that the guide surfaces are in each case formed by flanges extending at right angles to the upright side members and which are preferably symmetrically disposed in relation to the body of the side members.

In order to form conventional T-pieces, angles and bends in pipe insulation shells, it is sufficient to provide on one end face of a side member an oblique guide surface at an inclination of 45° and on the other end face a guide surface which extends at a right angle to the console, while centrally between these end faces there is a V-shaped cut-out having two guide surfaces which enclose an angle of 45° . The V-shaped cut-out is thereby so constructed that when the miter cut is being made, the pipe insulating shell cannot be cut through completely. This latter feature is achieved by the bottom of the cut-out being rounded, ending abut 2 to 3 mm above the console. Furthermore, this rounded shape prevents the danger of any incipient crack.

Where the mitering gauge according to the innovation is concerned, normally two side members are provided which are disposed parallel with and at a distance from each other and which are easily and separably mounted on the console by a kind of groove-and-tongue joint so that the gauge can be rapidly dismantled into three individual parts and then stowed in a space-savingly fashion for transport purposes. For adaptation to various diameters of pipe insulating shells which have to be cut, it is furthermore advantageously envisaged that, for variable supporting of a plurality of side members, the console comprise at least three grooves, of which the middle groove is disposed at a distance from the other two grooves in a proportion of 1/3:2/3. Thus, according to the particular diameter of pipe insulating shell which is involved, two different wide spaces can be created between the side members.

Finally, a suspension aperture is provided in the console makes it possible to hand the mitering gauge on a wall where it cannot be broken, for example if it is always used in the same place.

BRIEF DESCRIPTION OF THE DRAWINGS

Further details and advantages of the innovation are described in greater detail hereinafter with references to examples of embodiment shown in the accompanying drawings, in which.

DESCRIPTION OF THE PREFERRED EMBODIMENTS

Figure 1:
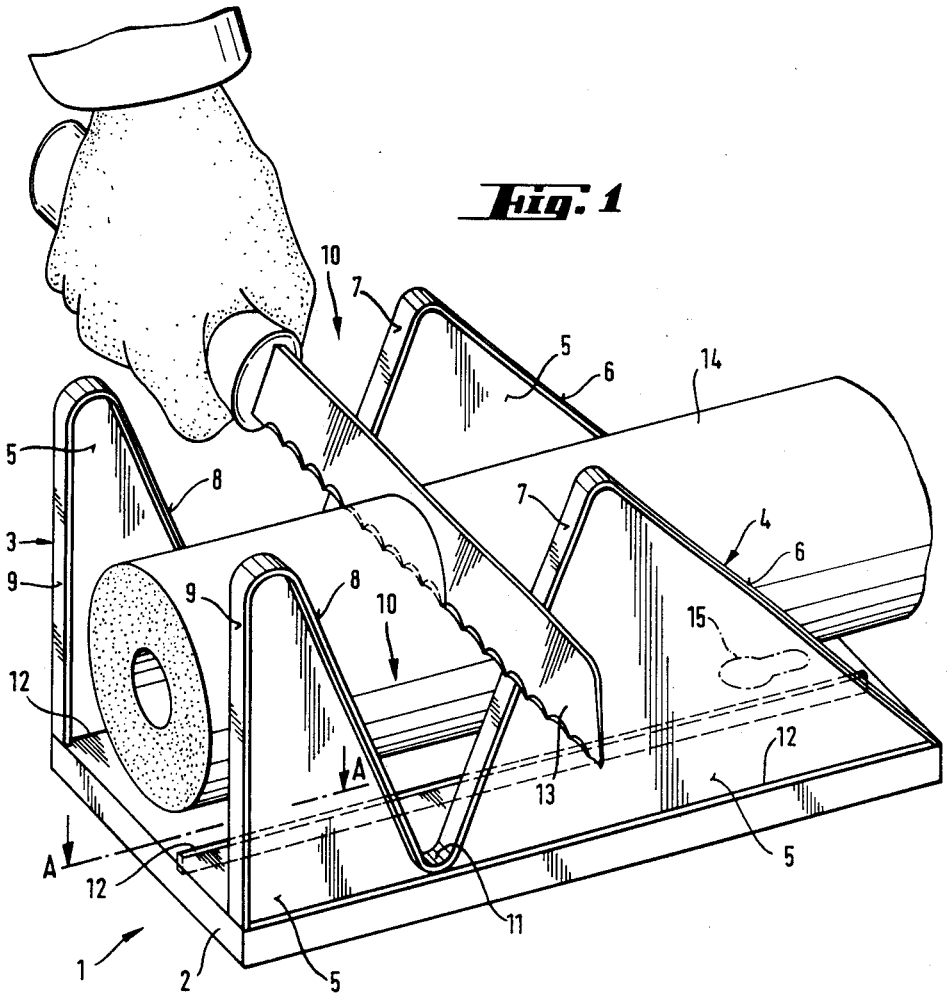
FIG. 1 is a perspective view of a mitering gauge in which is disposed a pipe insulating shell or which a miter is being cut and FIG. 2 is an enlarged detail taken on the line A—A in FIG. 1.
Figure 2:
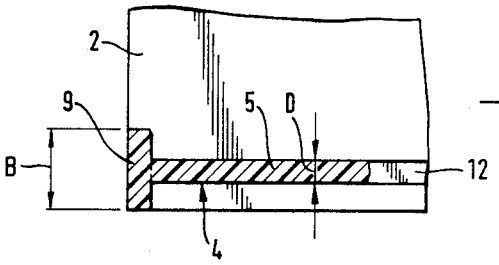

The mitering gauge 1 shown in perspective in FIG. 1 consists of a console 2 and two upright side members 3 and 4. The side members 3 and 4 comprise in each case a flat body 5 on the outside of which there are encircling guide surfaces 6 to 9, the thickness "D" of the body 5 being 1.5 mm while that of the width "B" of the guide surfaces 6 to 9 (see FIG. 2) is 7 mm. The guide surfaces 6 to 9 themselves are constructed as flanges which extend at a right angle to and which are symmetrical with the body 5. The oblique end guide surface 6 bounds an angle of 45° , while the guide surfaces 7 and 8 form a V-shaped cut-out 10 which encloses an angle of 45° . For straight cuts, finally, there is a guide surface 9 which extends at a right-angle to the console 2. The bottom of the V-shaped cut-out 10 is constructed as a rounded curve 11 which ends 3 mm before the surface of the console 2.

The side members 3 and 4 are in a known manner separably mounted on the console 2 by a kind of torque-and-groove joint. For this purpose, the guide surfaces 7 and 9 do not extend quite as far as the end of the side members 3, 4, so that the body 5 has in its bottom part a continuous tongue strip by means of which the side members 3, 4 can be fitted into a groove provided in the console 2 (the groove is not shown in detail). What is, however, shown is a groove 12 provided in the console 2 and which permits of a variable disposition of the side members 3, 4, in fact according to the diameter of a pipe insulating shell 14 which has to be mitered of a cutting blade 13. The groove 12 is thereby disposed at a distance from the two outer grooves, in a proportion of 1/3:2:3.

Finally, there is also provided (shown by dashdotted lines) in the console 2 a suspension aperture 15 so that the mitering gauge 1 can be hung up on a hook.

As a material for the present mitering gauge 1, an impact-resistant polystyrene is used, although other suitable materials are likewise conceivable.

What is claimed as new an desired to be secured by Letters Patent of the United States is:

1. Mitering gauge for cutting miters particularly on pipe insulating shells, which comprises:

a console; and at least one upright side member having first, second, third and fourth guide surfaces to guide a cutting tool, wherein the thickness of the body of the side member is smaller than the width of each of the guide surfaces of the side member, said first guide surface located at one end portion of said side member defining an angle of 45° with said console and wherein the upright side member also includes a V-shaped cut-out which defines said second and third guide-surfaces, said second and third guide surfaces enclosing an angle of substantially 45° and having at the other end portion of the side member said fourth guide surface which extends at substantially a right angle to the console.

2. Mitering gauge according to claim 1, wherein the bottom of the V-shaped cut-out ends at a distance above the console.

3. Mitering gauge according to claim 2, wherein the bottom of the V-shaped cut-out comprises a rounded curve provided in the body of the side member.

4. Mitering gauge according to claim 1, wherein for variable accommodation of a plurality of additional identical side members, the console comprises at least three grooves of which the middle groove is disposed at a distance from the other two grooves.

5. Mitering gauge according to claim 1, wherein said at least one side member comprises two identical side members disposed parallel with and at a distance from each other.

6. Mitering gauge according to claim 1, wherein the console has a suspension aperture formed therein.

* * * * *